United States Patent [19]

Salloum

[11] Patent Number: 4,895,316

[45] Date of Patent: Jan. 23, 1990

[54] MOLDED SECTIONAL REEL

[75] Inventor: James S. Salloum, Troy, Mich.

[73] Assignee: Creative Techniques, Inc., Auburn Hills, Mich.

[21] Appl. No.: 232,116

[22] Filed: Aug. 15, 1988

[51] Int. Cl.[4] ..... B65H 75/14; B65H 75/22

[52] U.S. Cl. ..... 242/71.8; 242/118.4; 242/118.6; 242/118.7

[58] Field of Search ..... 242/71.8, 118.4, 118.6, 242/118.7, 116, 115, 77.4

[56] References Cited

U.S. PATENT DOCUMENTS

| | | | |
|---|---|---|---|
| 1,702,242 | 12/1925 | Bureau | 242/77.4 |
| 2,190,013 | 2/1940 | Byers | 242/118.4 |
| 2,624,526 | 1/1953 | Green | 242/118.6 |
| 3,704,838 | 12/1972 | Bernier et al. | 242/115 X |
| 3,881,668 | 5/1975 | Poteat | 242/118.6 |
| 4,083,508 | 11/1978 | Pattillo | 242/71.8 X |
| 4,406,422 | 9/1983 | Phillips | 242/118.4 |
| 4,412,661 | 11/1983 | Wise et al. | 242/116 X |

FOREIGN PATENT DOCUMENTS

| | | | |
|---|---|---|---|
| 808511 | 9/1937 | France | 242/77 |

*Primary Examiner*—David Werner
*Assistant Examiner*—Phillip S. Han
*Attorney, Agent, or Firm*—Harness Dickey & Pierce

[57] ABSTRACT

A reel is formed of a plastic molded hub and side, disk-like flanges. The hub is made of thin-wall, cylindrical rings that are arranged end-to-end, and the flanges are made of two or more separate radial sections having radially oriented, overlapped edges that fasten together. Removable mechanical fasteners extend through passageways formed in the hub rings and through the flanges for fastening them together. The width of the reel may be varied by changing the number of rings. The diameters of the flanges may be varied by blocking off the outer portions of the mold in which the flask sections are molded to remove selected amounts of the peripheral portions of the sections for reducing the flange diameter. The hub rings and flange sections are interchangeable with like rings and sections for repair or reduced inventory purposes.

18 Claims, 2 Drawing Sheets

MOLDED SECTIONAL REEL

BACKGROUND OF THE INVENTION

This invention relates to an improved reel of the type having a generally cylindrical hub with opposite radially extending, disk-like flanges. Such reels are commonly used for carrying elongated tube, wire or strip types of objects which are wound around the hub between the flanges.

Conventional reels are commonly made of wood, metal, pressed fibers and plastic. The reel hub is rigidly secured to the opposite disk-like flanges. Conventionally, a different size reel is made for each different purpose.

Where relatively large-size reels are required, such as for winding elongated strips of a flexible material or relatively large tubing or the like, the same amount of space is needed for a reel carrying its full load as for an empty reel which may be returned for re-use. In addition, a reel, once damaged, is ordinarily not re-usable, since repair of these objects is relatively expensive compared to the overall cost of the reel.

Thus, there has been a need for a reel which, first, can be reduced in overall size for shipping, storage and inventory purposes when not used; second, which can be varied in size by using standard parts; and third, which can be easily repaired by utilizing interchangeable sections.

Thus, this invention relates to a reel formed of sections which are mechanically secured together and which may be interchanged with other like sections for adjusting the size of the reel, permitting the reel to be disassembled for shipping or storage when empty, and for replacing damaged sections when needed. This invention contemplates forming the reel sections out of molded plastic material which, when made in the manner described in this specification, produces a strong, rigid device capable of handling heavy loads when necessary.

SUMMARY OF INVENTION

This invention contemplates a reel formed of a central hub and end, disk-like flanges wherein the hub may be made of a number of cylindrical rings arranged end-to-end, and the flanges may be made of a number of radial sections which are secured together edge-to-edge. The rings and the flanges are mechanically connected together by bolt-like fasteners which extend through the assembled rings and flanges for releasably securing the parts together. Thus, the parts may be disassembled, when desired, for storage, handling, or replacement of parts as desired.

The invention further contemplates the substitution of different diameter flanges, as desired, by means of molding the flange sections in molds whose outer peripheral portions may be blocked off to produce smaller diameter or size sections. Thus, the same molds can be used to form larger and smaller sections, radially measured, so that these sections can be assembled together edge-to-edge to form different diameter flanges.

One of the objects of this invention is to provide a reel whose width can be adjusted merely by adding or subtracting cylindrical rings which are arranged end-to-end to form the extended reel hub.

Another object of this invention is to form the flanges of a reel out of separate pie-like sections, utilizing at least two and typically a number of sections which are fastened together edge-to-edge along their radial edge lines, so that the sections can be disassembled to reduce the size of the flange when desired for limiting the amount of space needed for storage or shipping an unused reel. In addition, the sections may be replaced with similar sections when necessary, such as, if they are damaged. Further, the sections may be made larger or smaller in the same mold merely by blocking off the outer peripheral edge portions of the mold to an amount needed to reduce the sections to predetermined sizes.

Yet a further object of this invention is to provide an inexpensive, plastic-molded, sectional reel which requires a minimum number of molds that are usable to form different-size reels and wherein the assembled reels are strong and rigid notwithstanding their being of relatively large size.

Further objects and advantages of this invention will become apparent upon reading the following description, of which the attached drawings form a part.

DETAILED DESCRIPTION

Figure 1:
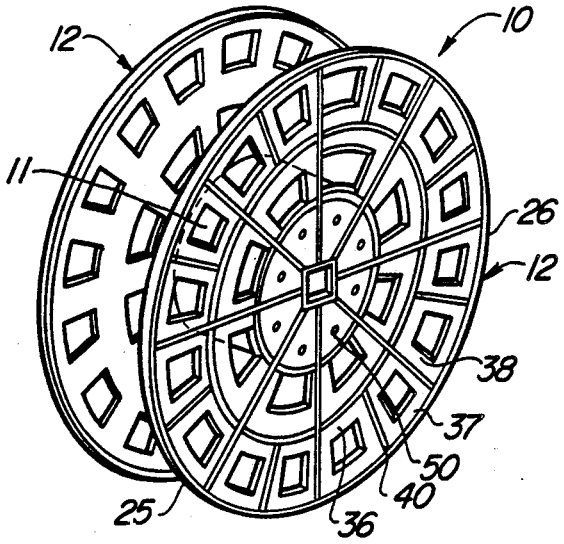
FIG. 1 schematically illustrates, in perspective, a reel formed in accordance with this invention.
Figure 2:
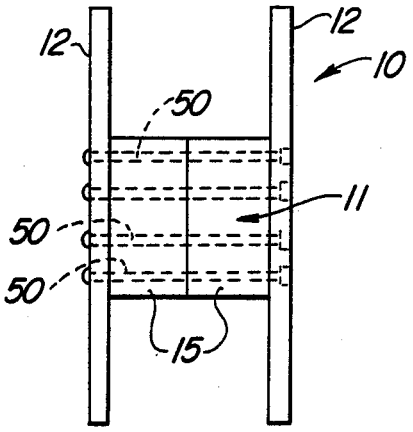
FIG. 2 is a side elevational view of the reel.
Figure 3:
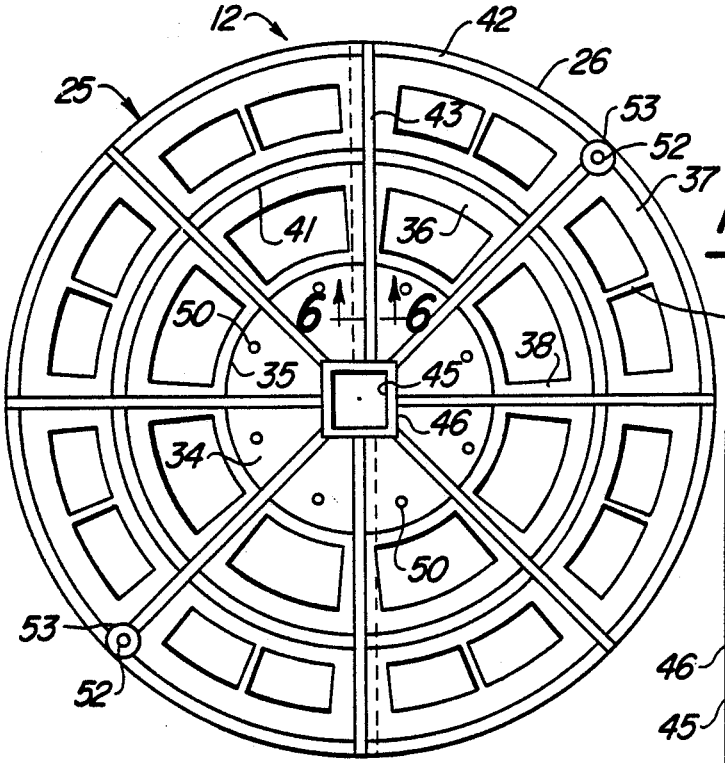
FIG. 3 is an end elevational view of the reel, illustrating the exposed face of one of its flanges.

FIGS. 1 and 2 illustrate a reel 10 having a hub 11 with end, radially extending flanges 12. The flanges are secured on the opposite ends of the hub.

Figure 4:
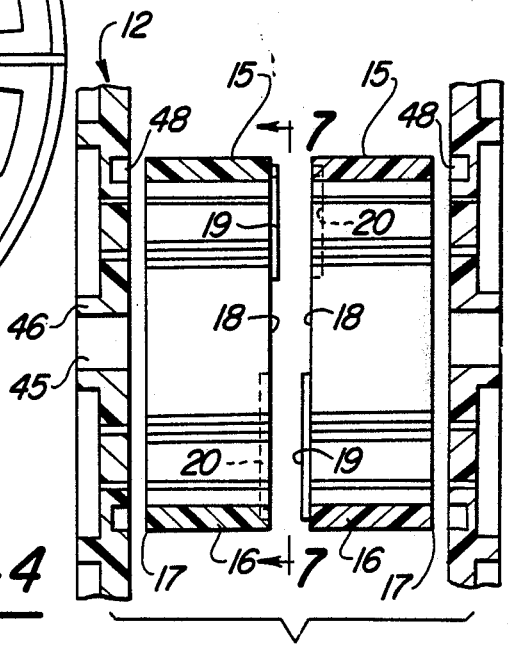
FIG. 4 is an enlarged, fragmentary, cross-sectional view of the central portion of the reel, showing the hub and flanges disassembled.

As shown in FIGS. 2 and 4, the hub is formed of cylindrically shaped rings 15 having a thin wall 16. Each ring has an outer edge 17, for engaging against its adjacent flange, and an inner edge 18 for engaging against its adjacent ring. The inner edges may be formed with raised central beads 19 for interfitting in grooves 20 formed in the opposite ring edge.

As shown in FIG. 4, two rings are arranged end-to-end with their respective beads fitting into opposite grooves. Where additional rings are used, the intermediate rings may be formed with beads and grooves on each of their opposite edges.

Figure 5:
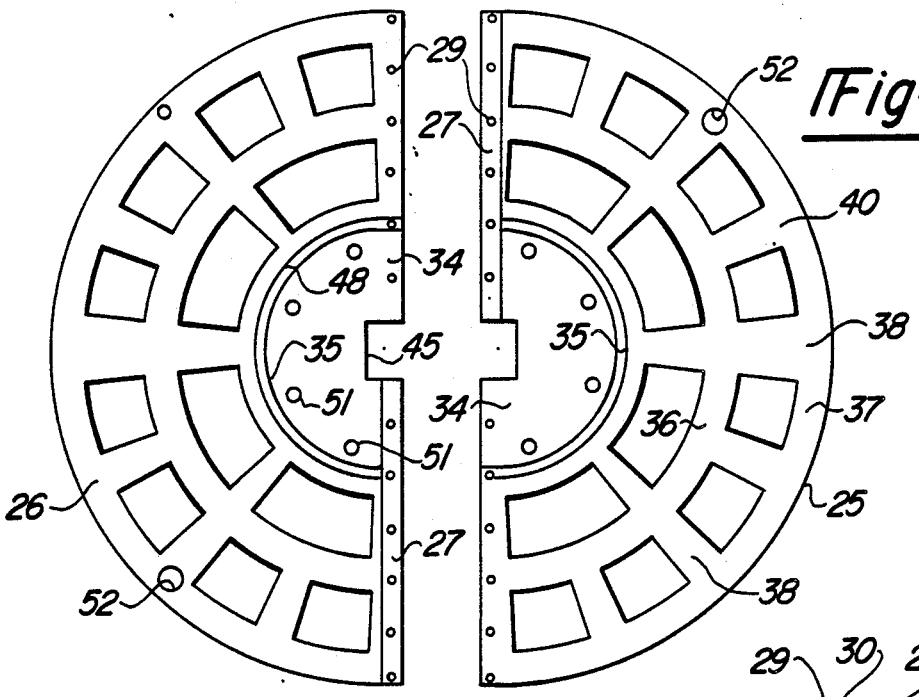
FIG. 5 is an elevational view of a two-section flange with the sections separated.
Figure 6:
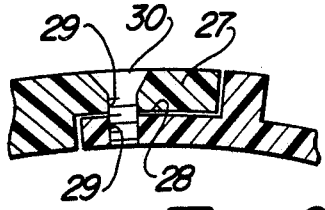
FIG. 6 is an enlarged, fragmentary, cross-sectional view showing the connection between the edges of two adjacent sections.
Figure 7:
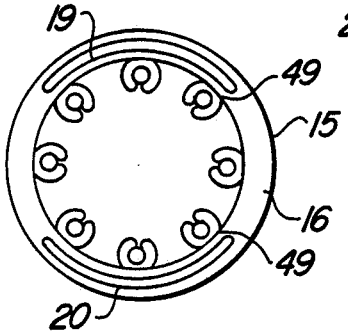
FIG. 7 is an end view, to a smaller scale, of one edge of a reel ring.

The flanges 12 are formed in radial sections. Thus, a single flange may be formed of two separate radial sections 25 and 26 (see FIG. 5) or a greater number of generally pie-like sections. Referring to the two-section flange illustrated in FIGS. 5 and 6, the adjacent radial edges of the sections are provided with edge tongues 27 and opposite overlapping rabbit portions 28. Thus, as illustrated in FIG. 6, the tongue 27 of one section fits over and is secured to the rabbit 28 of the next section by means of aligned holes 29 through which screws or the like 30 may be inserted. Preferably, screws are used for enabling rapid disassembly of the sections when desired.

When the flange sections are secured together, with their radial edges overlapped and fastened together, they form a central disk-like portion 34. An edge bead or raised rim-like flange 35 may be formed around the section for rigidification.

The central disk 34 is surrounded by a middle hoop portion 36 which, in turn, is surrounded by an outer hoop portion 37. The number of hoops may vary, depending upon the rigidity and strength requirements and the overall diameter required.

The hoop sections are interconnected by molded spoke sections 38. Additional spoke sections 40 may be utilized between the middle and outer hoop for reinforcement and rigidification. In addition, a reinforcing bead or raised part 41 is formed on the middle hoop, and a similar reinforcing bead 42 is formed on the outer hoop. Ribs or beads 43 are formed on the spokes. These ribs or beads are all integral with their respective hoop or spoke parts.

The center of each flange is provided with a central hub socket 45 which is surrounded by a raised rib 46 for rigidification. The socket may be square, rectangular, circular or some other shape, as desired. The sockets formed in the opposite flanges permit the reel to be mounted upon a suitable axle for supporting the reels and for permitting them to be rotating for unwinding or winding articles upon them.

An annular groove or seat 48 is formed in the central disk portion 34 of each flange for receiving the adjacent end portion 17 of the hub ring. This seat positions the hub relative to the flange and maintains the parts in their required relationship.

The interior wall surface of the rings are each formed with elongated, molded passageways 49 which can be tubular in shape. Preferably, the tubular-shaped passageways are split or open along their inner edges in alignment with the axis of the respective rings, as illustrated in FIG. 6. Long bolts 50 are inserted through the aligned passageways of the rings that are arranged end-to-end. The bolts extend through holes 51 in the central disk portion 34 of the flanges. Thus, the bolts 50 fasten the rings 15 together and fasten the rings to the flanges to form a complete, rigid reel. The elongated metal bolts, additionally, serve to reinforce and strengthen the reel. Since the passageways are preferably split, shocks or loads upon the reel hubs, such as during shipping or if the reel is dropped, permit some flexibility of the plastic hub relative to the more rigid metal bolts to avoid breakage of the hub.

Holes 52 may be formed in the flanges, near their outer peripheral edges. These holes may be surrounded with raised beads 52 for reinforcement purposes. The holes may receive hooks or cables or the like for lifting the reel.

Figure 8:
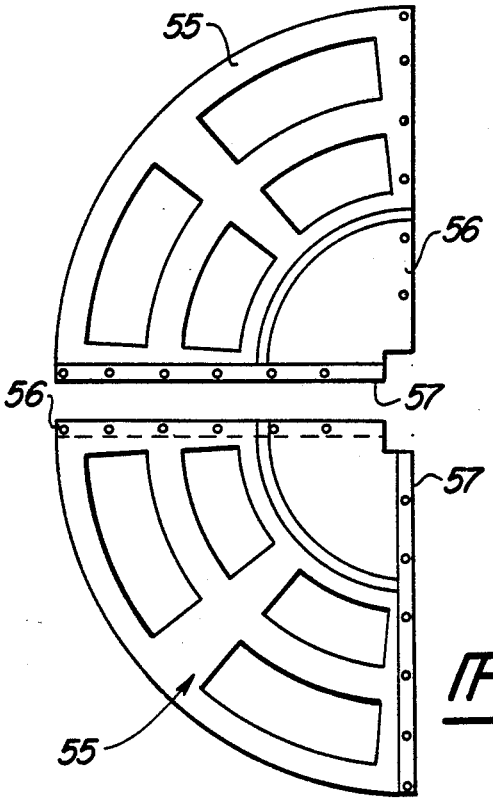
FIG. 8 is an elevational view of two quarter-size, pie-like flange sections.

As illustrated in the embodiment shown in FIG. 8, the flange may be made in a number of identical sections 55. Thus, FIG. 8 shows the sections formed as quarters, each having radial edges or tongues 56 and rabbits 57 which overlap and are fastened by screws or the like to the edge of the next adjacent quarter section. The number of sections may be varied, such as by using three sections or more than four sections. Thus, a single mold may be used to make a large number of similar small sections, and the sections may be mechanically fastened together. This permits disassembly of the flanges so that they may be easily stored or shipped in smaller spaces. Moreover, broken or damaged sections may be easily replaced when desired with like sections.

Figure 9:
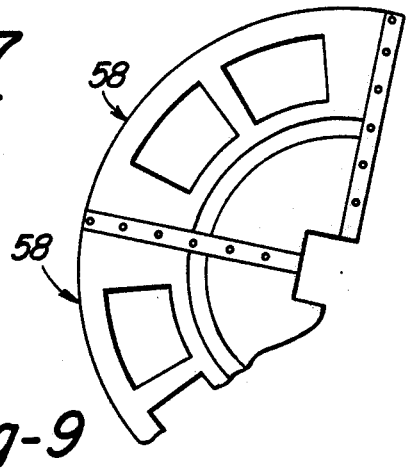
FIG. 9 is a fragmentary, elevational view of a flange section having a smaller diameter.

In addition, since the molds may be used for forming large-size reels, such as on the order of reels having flanges that are three or more feet in diameter, and hubs that may be more than one foot in diameter, a single mold may be used to form different diameter flanges. That is, by using a single flange mold, the outer portions of the mold may be blocked off, when desired, to form smaller diameter flanges, that is, radially shorter flange sections. This is illustrated in FIG. 9 where the flange sections 58 are smaller because the outer hoop 37, the additional spokes 40 and the outermost portions of the molded spokes 38 have been omitted by blocking the mold in which the sections are made.

This invention may be further developed within the scope of the following claims. Accordingly, it is desired that the foregoing description be read as being merely illustrative of an operative embodiment of this invention and not in a strictly limiting sense.

Having fully described at least one operative embodiment, I now claim:

1. A reel formed of a central hub with radially outwardly extending flanges on the opposite ends of the hub, comprising:

the hub being a plastic molded, thin-wall, relatively wide ring having an exterior wall surface, about which a reeled article may be wound, and an interior wall surface, and opposite, narrow, annular edges defining the opposite ends of the ring;

said flanges being formed of generally flat, disk-like plastic moldings having a central portion for overlying the ends of the hub and an outer portion for extending radially outwardly of the hub;

a continuous annular seat formed on the faces of the flanges adjacent to the hub ends and corresponding in shape to the hub edges, with said hub edges each engaging against its adjacent seat;

a number of elongated passageways integrally molded on the interior surface of the hub wall, with the passageways being circumferentially spaced apart and being arranged parallel to the axis of the hub;

elongated fasteners extending through the passageways and through corresponding aligned openings formed in the flange portions overlapping the ends of the hub, and with the fasteners rigidly securing the flanges to the hub;

said flanges being formed of plastic molded, substantially identical, radial sections, with each section having an exterior peripheral edge defining a portion of the periphery of the flange and having an outer portion forming part of the flange between the flange peripheral edge and the hub, and an inner portion overlapping a portion of the hub;

the adjacent radially directed edges of each section being formed to interengage with each other and being fastened together to form the rigid complete flanges;

whereby different flange sections may be interchanged and fastened together and to the hub for forming an assembled reel.

2. A reel as defined in claim 1, and said elongated fasteners comprising removable bolts extending through passageways formed internally of the hub and through the opposite flanges for releasably fastening the hub and flange sections together.

3. A reel as defined in claim 1, and including each of said flanges being formed of at least two radial flange sections.

4. A reel as defined in claim 3, and including the adjacent edges of each of the flange sections having integral, narrow strip-forming portions which portions are overlapped and fastened together to form the complete flange.

5. A reel as defined in claim 1, and including each of the flanges being formed of more than two pie-slice-shaped sections.

6. A reel as defined in claim 5, and including aligned holes formed in the overlapped edges of the adjacent flanges sections and including removable fasteners extending through the holes for fastening the sections together.

7. A reel as defined in claim 6, and including each of the flanges formed of spoke-like extensions extending radially to the outer peripheral edge of the flange,and including hoop-like rings interconnecting the spokes at predetermined locations spaced from the axial center of each flange.

8. A reel as defined in claim 1, and including central sockets formed at the axial center line of the hub in each of the opposite flanges for receiving an axle-like support upon which the reel may be mounted.

9. A reel as defined in claim 1, and including said hub being formed of at least two separate, substantially identical rings engaged end-to-end, with the rings being separable and interchangeable with like rings.

10. A reel as defined in claim 9, and each of the rings having aligned, open-sided passageways formed integral with its interior wall surfaces and with the rings being held together by removable, elongated, bolt-like fasteners which extend through the aligned passageways of the rings and through the opposite flanges.

11. A reel as defined in claim 10, and including the adjacent edges of the two rings having interfitted tongue and groove members formed thereon for interengaging said edges.

12. A reel as defined in claim 10, and including passageways formed of tube-like molded portions integrally formed on the inside walls of the rings and extending inwardly in an axial direction relative to the rings.

13. A reel as defined in claim 1, and including the seats on the flanges being formed as annular grooves into which the adjacent narrow edges of the hubs are fitted.

14. A reel as defined in claim 13, and including the flanges being formed of at least two flange sections, with the flange sections being removable and replaceable with like size and shape sections and with the diameters of the sections being selectively variable for forming different diameter size flanges as desired.

15. A reel as defined in claim 1, and including the flanges being forming of a number of substantially identical radial sections, and wherein the radius of each of the sections may be varied for assembling desired diameter flanges.

16. A reel formed of a central hub with radially outwardly extending side flanges on the opposite ends of the hub, comprising:

the hub being formed of a number of thin-wall, plastic-molded, relatively wide rings having an exterior wall surface about which an article may be wound, and an interior wall surface and opposite, narrow, annular edges defining the opposite ends of the rings, with the rings being arranged end-to-end;

the flanges being formed in a generally flat, disk-like shape having a central portion for overlapping the ends of the hub and an outer portion for extending radially outwardly of the hub;

the opposite ends of the hub engaging an annular seat in three adjacent faces of the flanges;

the flanges being formed of a number of plastic-molded, substantially identical, radial sections, with each section having an exterior peripheral edge defining a portion of the periphery of the flange, and having an outer portion forming part of the flange between the flange peripheral edge and the hub, and an inner portion overlapping a portion of the hub;

the sections each having a radially directed edge, with adjacent section edges being interengaged and fastened together by mechanical fasteners to form a rigid complete flange;

elongated passageways integrally molded on the interior surface of the hub wall, with the passageways being circumferentially spaced apart and being arranged parallel to the axis of the hub;

elongated bolt-like fasteners extending through the passageways and through corresponding aligned openings formed in the flange portions overlapping the ends of the hub, with the fasteners rigidly securing the flanges to the hubs;

said fasteners being selectively removable for disassembling the rings from each other and from the flanges;

whereby different flange sections may be interchanged with each other and fastened together to form flanges of preselected diameters and the number of hub rings may be varied for varying the width of the reel, with the reel hub rings and flanges being disassemblable from each other and into separate sections for facilitating non-use handling and storage.

17. A reel as defined in claim 16, and including groove-like seats formed on the surfaces of the flanges for receiving the adjacent end portions of the hub rings for connecting the rings and the flanges together.

18. A reel as defined in claim 17, and including a number of pie-slice-shaped sections forming each of the flanges, with the adjacent radial edges of the adjacent sections mechanically fastened together.

* * * * *